United States Patent [19]

Ascher

[11] 4,327,536

[45] May 4, 1982

[54] COMPOSITE BUILDING PANEL

[75] Inventor: Raymond R. Ascher, West Bloomfield, Mich.

[73] Assignee: Linx Building Systems Corp., Southfield, Mich.

[21] Appl. No.: 128,295

[22] Filed: Mar. 7, 1980

[51] Int. Cl.[3] ..... E04C 2/26

[52] U.S. Cl. ..... 52/309.12; 52/811; 52/DIG. 7

[58] Field of Search ..... 52/309.1–309.17, 52/811, DIG. 7; 428/81, 166, 185; 156/307.1

[56] References Cited

U.S. PATENT DOCUMENTS 3,213,570 10/1965 Abramson ..... 52/309.2
3,842,559 10/1974 Payne ..... 52/309.12
4,169,180 9/1979 McDonagh ..... 52/DIG. 7

*Primary Examiner*—J. Karl Bell
*Attorney, Agent, or Firm*—Arnold S. Weintraub

[57] ABSTRACT

A composite building panel is disclosed. This building panel is comprised of at least one metal reinforcing member; a layer comprised of glass fiber, said layer being fastened to said metal reinforcing member(s); and a three-dimensional, cross-linked polyester resin layer which abuts said glass fiber layer.

12 Claims, 4 Drawing Figures

COMPOSITE BUILDING PANEL

BACKGROUND OF THE INVENTION

I. FIELD OF THE INVENTION

The present invention relates to a lightweight, composite building panel.

II. DESCRIPTION OF THE PRIOR ART

Many modern day buildings utilize substantial amounts of brick, glass, and pre-cast cement in order to form their exterior structures. Cement is relatively heavy and expensive, and forms cast from it are bulky; thus, construction with cement parts often is impractical.

While the prior art has attempted to provide components which possess many of the advantages of cement components but which are substantially cheaper and lighter; it has not been entirely successful in so doing.

Some relevant referrences encountered by Applicant during the preparation of this application include U.S. Pat. No. 2,839,442 (a process for preparing a lightweight structural panel having a smooth continuous facing), U.S. Pat. No. 3,616,144 (a wall tile comprising a core portion, a facing layer, and a backing layer wherein the core portion comprises a particulate filler material and a resinous binder), U.S. Pat. No. 3,660,199 (a process for preventing measling upon the heating of an epoxy resin-glass fiber laminate), U.S. Pat. No. 3,745,052 (a building panel with high relief aggregate face), U.S. Pat. No. 3,953,629 (a synthetic concrete laminate), and U.S. Pat. No. 4,001,474 (a honeycomb panel cellular structure).

III. BRIEF SUMMARY OF THE INVENTION

In accordance with this invention, there is provided a composite building panel which comprises at least one metal reinforcing member; a layer comprised of glass fiber, said layer being fastened to said metal reinforcing member(s); and a three-dimensional, crosslinked polyester layer which abuts said fiberglass layer.

IV. BRIEF DESCRIPTION OF THE DRAWING

DESCRIPTION OF THE PREFERRED EMBODIMENTS

Figure 1:
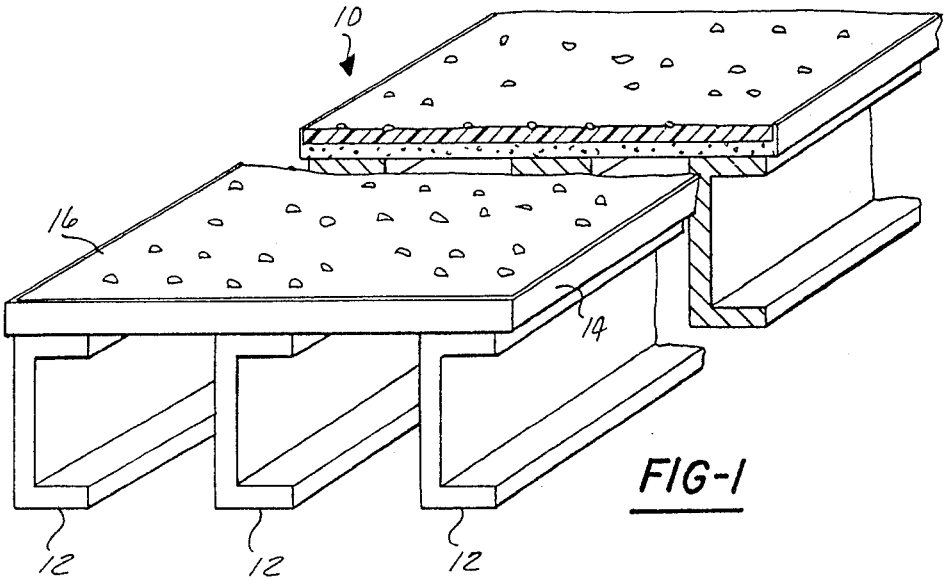
FIG. 1 is a perspective view of the front of the composite building panel of this invention.

The drawing illustrates one of the preferred embodiments of this invention. Many other embodiments will suggest themselves to those skilled in the art and they are intended to be comprehended within the scope of this invention.

Figure 2:
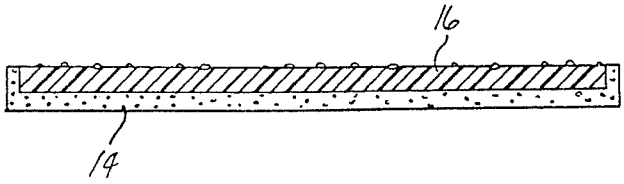
FIG. 2 is a cross-sectional view of the three-dimensional, crosslinked polyester resin layer being formed in situ in a pan which consists essentially of said glass fiber layer.

Referring to FIGS. 1 and 2 composite building panel 10 is comprised of at least one metal reinforcing member 12, a layer 14 comprising glass fiber which is fastened to said metal reinforcing member(s) 12, and a three-dimensional, cross-linked polyester resin layer 16 which abuts said glass fiber layer 14. Fastening means, such as screws 18, FIG. 4, may be used to secure the glass fiber layer 14 to the metal reinforcing member 12. The screw 18, as shown, is a double headed screw which is used to penetrate and fix the fiber layer to the member 12. By employing a double headed screw a portion thereof extends above the fiber layer. Hence, when the resin is cast on the fiber layer, it encapsulates the extension or second head portion 19. Thus, by employing a double headed screw both a mechanical bond and a chemical bonding is achieved. Of course, other mechanical fasteners may be used, if desired.

Aggregate particles may be embedded in the polyester layer to impart an aesthetic appearance to the composite.

In a first embodiment the composite building panel of this invention comprises metal reinforcing member(s) 12, glass fiber layer 14, three-dimensional polyester resin layer 16, and, optionally, one or more layers of material(s) known to those in the art to be useful in laminated building panels such as aggregate stone, or a mold finish. Also, epoxy resin, polyester resin, concrete, synthetic concrete, butadiene copolymer resin, polyethers, glass fibers, and the like may be used in the composite building panel of this invention. The building panel of this invention preferably contains from about 2 to about 20 composite layers.

Figure 3:
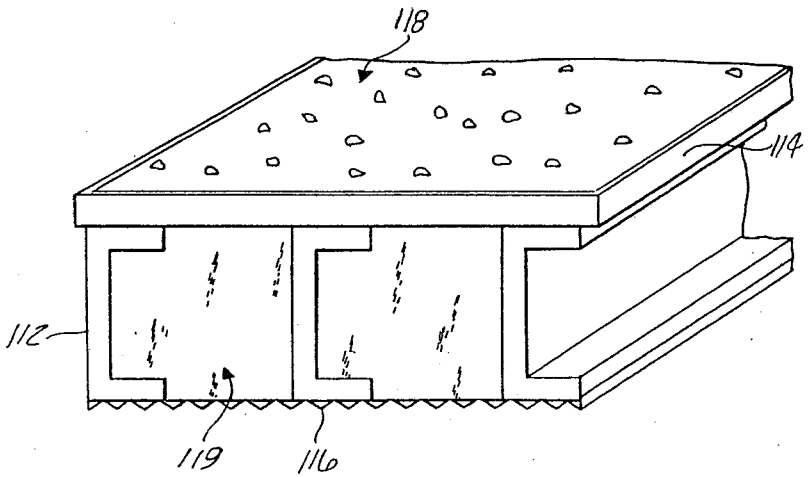
FIG. 3 is a perspective view of another embodiment of the building panel of this invention.
Figure 4:
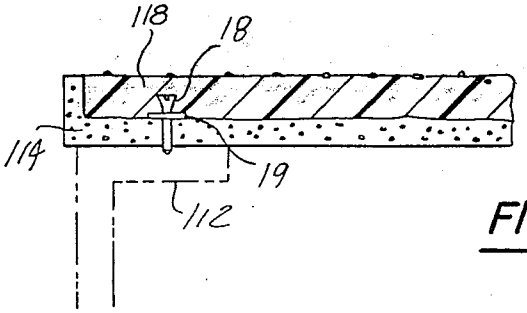
FIG. 4 is a cross-sectional view of the building panel shown in FIG. 3.

In a further embodiment of the present invention, shown in FIGS. 3 and 4, the composite building panel of this invention is comprised of at least two metal reinforcing members or channels 112. A glass fiber layer 114 is attached to these metal reinforcing members, in the manner heretofore described, and the spaces between said metal reinforcing members are filled with cellular cement or other lightweight cellular materials, such as a polyurethane form, polystyrene foam, gypsum, or other organic or inorganic foam material, as shown in general by reference number 119. It is preferred to use cement or other foam material with a density of from about 3 to about 30 pounds per cubic foot, the most preferred material having a density of about 25 pounds per cubic foot.

The cellular material adds heat qualities or insulative characteristics as well as fire retardency to the composition hereof. The composite further includes a lath 116 secured to the opposite side of the channel from that of the glass fiber layer 114. The lath surface, thus, defines an interior wall structure which may be plasticed or otherwise finished to form an interior wall. The lath may be secured to the frame or channel members 112 by any suitable mode including fasteners, welding or the like.

A polyester resin is cast upon the glass fiber layer 114 to form a layer 118 which defines an exterior wall. The layer 118 may be impregnated with aggregate particles or further coated. In any event, the lath, channel members, form, glass fiber and resin composite all cooperate to define a building panel structure which includes both interior and exterior finished walls. In practicing this embodiment, a plurality of refinforcing members are arrayed and interconnected into a suitable network. Then, a lath is secured to one end of the members.

Next, a foaming material is placed in the spaces between the reinforcing members 112 and foamed in situ. Next, the glass filled fiber layer 114 is deposited onto the opposite end of the reinforcing members. This can be done by affixing a fiber pan thereto or, alternatively, spraying the fiber layer thereonto. In this regard it must be noted that the surface defined by the channel or frame members 112 and the foam 119 which fills the spaces therebetween constitute a mold for the spraying of the fiber.

In the building panel of this invention, the glass fiber layer is bonded to a three-dimensional polyester resin layer. The bond may be mechanical in nature and may be created by the use of fastening means well known to the art. In such instances the resin is cast independently and away from the fiber layer 14 or 116. It is preferred, however, that the bond be created by forming layer 16 or 118 in situ in place on glass fiber layer 14 or 114. In this embodiment, the glass fiber layer is charged with the reactants required to prepare the three-dimensional cross-linked polyester resin layer; and resin layer is formed right on top of glass fiber layer. In such, a double headed fastener 18 is enclosed by the resin and serves as an auxiliary fastener or bonding member.

A three-dimensional, cross-linked polyester resin is used to prepare the building panel of this invention. There are at least two methods for preparing the three-dimensional, cross-linked polyester resin. In the first method, the polymerization reaction is conducted with monomers in which the functionality of one monomer is at least two and the functionality of the other monomer is more than two. In the second method, a linear, unsaturated polyester is reacted with a vinyl-type monomer to produce an unsaturated polyester resin. It is preferred to use the three-dimensional, unsaturated, cross-linked polyester resin to prepare the structures of this invention.

The unsaturated polyester resins used to prepare the panel of this invention are well known to those skilled in the art. They may be produced by reacting a linear, unsaturated polyester with an unsaturated, vinyl-type monomer.

Linear, saturated polyesters may be prepared from dibasic acids and dihydric alcohols. If either or both of the saturated, bifunctional reactants is replaced with reactants containing unsaturation, linear unsaturated polyesters are formed; when they are cured with the vinyl-type monomer, cross-linking occurs among the individual linear polymer chains and the unsaturated polyester resin is formed.

The unsaturated polyester resins known to the art may be used in the panel of this invention; and they may be prepared by methods well known to the art. Thus, for example, they may be prepared by the procedures described in B. Golding, Polymers and Resins, pp. 303–314 (Van Nostrand Company, Inc., New Jersey, 1959); J. Stille, Introduction to Polymer Chemistry, pp. 90–93 (John Wiley and Sons, Inc., New York, 1962); R. S. Morrell (ed.), Synthetic Resins and Allied Plastics (Oxford University Press, London, 1951); Bjorksten Research Laboratories, Inc., Polyesters and Their Applications (Reinhold Publishing Co., New York, 1956); and the like. These publications are hereby incorporated by reference into this patent application. The unsaturated polyester resins described in these publications may be used in the structures of the present invention. The processes, initiators, linear unsaturated polyesters, and unsaturated vinyl-type compounds described in these publications may be used to prepare unsaturated polyester resins which are useful in the panel of this invention.

It is preferred that the crosslinked polyester resin used in the panel of this invention contain a filler. It is preferred to use from about 10 to about 50 percent (by combined weight of filler and polyester resin) of filler. It is more preferred to use from about 15 to about 30 percent (by weight) of filler. In the most preferred embodiment, from about 20 to about 25 percent of filler is employed.

Any of the fillers well known to those skilled in the art may be used in the crosslinked polyester resin. Furthermore, one may employ other materials in the crosslinked polyester resins where one desires to achieve a particular end result. Such materials include, without limitation, adhesion promoters; antioxidants; antistatic agents; antimicrobial agents; colorants; heat stabilizers; light stabilizers; fillers; reinforcing agents; and other materials well known to those skilled in the art which have been or could be used with polymer compositions and which are described, e.g., in Modern Plastics Encyclopedia, Vol. 52, No. 10A, McGraw-Hill, Inc., New York, N.Y. (1975). Said encyclopedia is hereby incorporated in toto by reference into this disclosure.

The above described materials which may be used in the crosslinked polyester resins can be employed in any amounts which will not substantially adversely affect the properties of these compositions. Thus, the amount used can be zero (0) percent, based on the total weight of the composition, up to that percent at which the composition can still be classified as a resin. In general, such amount will be from about 0 percent to about 80 percent.

It is preferred that the filler used be a silica sand.

The filler may be incorporated into the polyester resin by means well known to those in the art. Thus, for example, it may be mixed with the linear, unsaturated polyester and/or the unsaturated, vinyl-type compound prior to the time these components are reacted together to form the unsaturated polyester resin. Other methods of incorporating the filler into the resin which are known to the art also may be used.

In one preferred embodiment, the aforementioned vinyl-type monomer is of the formula:

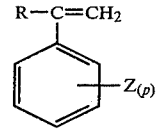

wherein R is selected from the group consisting of hydrogen, lower alkyl of from 1 to about 6 carbon atoms, and halogen; Z is selected from the group consisting of vinyl, hydrogen, chlorine, and lower alkyl of from 1 to about 6 carbon atoms; and p is a whole number of from about 0 to about 5.

The most preferred vinyl-type monomer is styrene. When it is used, it is preferred to use from about 30 to about 70 percent (by combined weight) of styrene. In an even more preferred embodiment, from about 40 to about 60 percent (by combined weight) of styrene is used. In the most preferred embodiment, from about 45 to about 55 percent (by combined weight) of styrene is utilized.

In one embodiment, after the glass-filled layer 14 or 114 is formed, wooden slats are placed around the sides of glass-filled layer 14 or 114 to form a boundary; the reactants required to form the three-dimensional polyester resin layer 16 or 118 are poured on top of layer 14 or 114, whereby said reactants are prevented from flowing off of the top of glass-filled layer; and after polyester resin 16 or 118 has hardened, the wooden slats are removed. In another embodiment, illustrated in FIG. 3, glass-filled layer 114 is formed with sides which act as boundaries and restrain said reactants from flowing off of the top of the glass-filled layer 114 after they have been charged.

The glass-filled layer is comprised of from about 25 to about 100 percent (by weight) of glass fiber. It is preferred that glass-filled layer be comprised of from about 30 to about 80 percent (by weight) of glass fiber. In a more preferred embodiment, glass-filled layer is comprised of from about 33 to about 60 percent of glass fiber.

Any material which may be filled with glass fiber may be used in glass-filled layer 14 or 114. Thus, for example, one may use glass-filled epoxy resin, glass-filled polyester, and the like in the glass-filled layer.

In one embodiment, glass-filled epoxy resin is used in glass-filled layer 14 or 114. The epoxy resin used is as described in the Encyclopedia of Polymer Science Technology, Vol. 6, pp. 209–270 (Interscience, New York, 1967). This publication is hereby incorporated by reference into this application.

The epoxy resins that may be employed in the practice of the present invention may be those which are known in the art, although it is preferred to use DGEBA (diglycidyl ethers of Bisphenol A). Detailed descriptions of suitable epoxy resins, modifiers, curing agents, accelerators, fillers, glass cloths, manufacturing conditions, etc., may be found in the Encyclopedia of Polymer Science and Technology, Vol. 6, pp. 209–270 (Interscience Publishers, New York, 1967) and in the Handbook of Epoxy Resins, by Henry Lee and Kris Neville (McGraw-Hill, New York, 1967).

The preferred epoxy resins, of the DGEBA type, are made by the reaction of Bisphenol A with excess epichlorohydrin in an inert atmosphere under alkaline conditions to neutralize the hydrogen chloride resulting from the condensation. Instead of using alkali, Friedel-Crafts catalysts may be employed, such as zinc chloride or boron trifluoride, followed by dehydrohalogenation with a compound such as an aluminate, silicate or zincate in a substantially non-aqueous medium. The epoxide equivalents of such compounds are generally in the range of 150 to 1,000 and usually are about 200 to 600. The average molecular weights are from 340 to about 1,500, preferably 340 to 1,200.

Instead of DGEBA, other epoxies, such as the glycidyl ethers of glycerol, glycidyl ethers of Bisphenol F, polyglycol glycidyl ethers, glycidyl ethers of tetrakis(-hydroxyphenyl)ethane, phenyl glycidyl ethers and epoxylated novolacs may be used. Furthermore, various mixtures of epoxy resins may be employed, either as physical mixtures of different types or epoxies or as chemical combinations, having different resin-forming portions reacted into one epoxy molecule. Additionally, the epoxy resins may be utilized with other types or resins so as to obtain desired modifications of physical and chemical properties.

In one preferred embodiment, the glass-filled layer is glass-filled polyester. It is preferred that this glass-filled polyester be glass-filled linear unsaturated polyester. The preparation of these linear, unsaturated polyesters has been described hereinabove and is well known to those skilled in the art.

The preferred unsaturated polyesters are thermosetting materials which, when properly catalyzed, convert from a liquid state to infusible solids. This polymerization reaction, usually termed "curing", may be initiated through the addition of a catalyst such as an organic peroxide catalyst.

In one embodiment, the layer comprised of glass fiber consists essentially of glass-filled polyester with which has been admixed from about 0.50 to about 5.0 percent (by combined weight of glass-filled polyester and peroxide catalyst.

Useful organic peroxide catalyst include, for example, methyl ethyl ketone peroxide, benzyl peroxide, dimethyl peroxide, butyl peroxide, cumylmethyl peroxide, t-butyl-t-pentyl peroxide, t-butyl diphenylmethyl peroxide, dicumyl peroxide, 1,2-dioxane, triphenylmethane peroxide, dilauryl peroxide, dibenzoyl peroxide, methyl isobutyl ketone peroxide, methyl amyl ketone peroxide and the like, as well as mixtures thereof. The preferred catalyst is methylethyl ketone peroxides.

It is preferred that, after the glass-filled polyester has been admixed with the catalyst, the glass-filled polyester be cured under ambient conditions.

In one embodiment, the three-dimensional polyester resin layer is formed by admixing methyl ethyl ketone peroxide said linear, unsaturated polyester, and styrene and thereafter allowing this layer to cure under ambient conditions.

The metal reinforcing member 12 or 112 may be constructed of any metal commonly used in the building trades art. The term "metal", as used in this specification, includes one or more electropositive elements and alloys. Thus, for example, steel, iron, brass, aluminum, copper, lead, chromium, bronze, and the like are metals which may be used in the reinforcing member. The metal reinforcing member is comprised of at least about 50 percent by weight of one or more of said metals.

The metal reinforcing member may be in any shape which will lend structural integrity to the building panel of this invention.

It should be noted that where the three-dimensional polyester is cast in situ some portion thereof will invade interstices of the glass-fiber layer. Because the peroxide catalyst is preferably the same as the peroxide used with the glass-fiber, an adverse effect occurs because of this commingling.

The following Example is presented to illustrate the invention and should not be deemed to be limitative thereof. Unless otherwise stated, all parts are by weight, all temperatures are in degrees centigrade, and all volumes are in milliliters.

EXAMPLE

One hundred parts (by weight) of chopped glass fiber is mixed with two hundred parts (by weight) of Polylite® 32-131 polyester (an unsaturated, liquid polyester with a viscosity of 1300–1800 cps and a density of 1.14–1.16 kilograms per liter which is purchased from the Reichhold Chemicals, Inc. of White Plains, N.Y.). To this mixture is added two parts (by weight) of methyl ethyl ketone peroxide; and the mixture is allowed to cure at room temperature for from about thirty to about forty-five minutes. The chopped glass-fiber mixture is sprayed onto a bed of spaced apart channels having the spaces therebetween filled with a 25 pound cubic foot density cement. After the glass-fiber is set it is attached to the channel members with suitable mechanical fasteners. Thereafter, wooden slats are erected around the perimeter of the glass-fiber polyester layer to form a boundary and a mixture of Polylite® polyester and styrene (in a weight of ratio of 45/55) is charged to the top of the glass-fiber layer.

About 0.75 parts of methyl ethyl ketone peroxide per hundred parts of polyester/styrene mixture are added to this mixture, and the polyester/styrene mixture is allowed to cure at room temperature for about 120 minutes.

Many other ramifications and modifications will suggest themselves to those skilled in the art. They are intended to be comprehended within the scope of this invention.

The embodiments of this invention in which an exclusive property or privilege is claimed are as follows:

1. A composite building panel which comprises at least one metal reinforcing member; a layer comprised of glass fiber, said layer being fastened to said metal reinforcing member(s); and a three-dimensional, cross-linked polyester resin layer which abuts said fiberglass layer.

2. The building panel of claim 1 wherein said layer comprised of glass fiber consists essentially of glass-filled polyester.

3. The building panel of claim 2 wherein said glass-filled polyester consists essentially of glass-filled, linear unsaturated polyester.

4. The building panel of claim 3 wherein said cross-linked polyester resin is an unsaturated polyester resin which is cross-linked with a vinyl monomer in the presence of an organic peroxide catalyst.

5. The building panel of claim 4 wherein said glass-filled polyester is admixed with from about 0.50 to about 5.0 percent (by combined weight of glass-filled polyester and peroxide) of an organic peroxide.

6. The building panel of claim 4 wherein the peroxide admixed with the glass-filled polyester is the same as the peroxide catalyst.

7. The building panel of claim 6 wherein said peroxide is methyl ethyl ketone peroxide.

8. The building panel of claim 1 wherein the glass-fiber layer contains from about 25 to 100 percent by weight of glass-fiber material selected from the group of glass-filled polyester and glass-filled epoxy resin.

9. The building panel of claim 1 wherein said cross-linked polyester resin is an unsaturated polyester resin.

10. The building panel of claim 1 which further comprises:

(a) a plurality of spaced apart reinforcing members, (b) a lath secured to one end of the reinforcing members, (c) a foamable material disposed in the spaces between the reinforcing members, and wherein the glass-fiber layer is affixed to the reinforcing members at the end opposite that of to which the lath is affixed.

11. The building panel of claim 10 wherein the cross-linked polyester layer contains from about ten to fifty percent, by weight, of a filler.

12. The building panel of claim 10 wherein the foamable material is a foamable cement which is foamed in situ.

* * * * *